US006592010B2

(12) United States Patent
Plessis

(10) Patent No.: US 6,592,010 B2
(45) Date of Patent: Jul. 15, 2003

(54) FLUID DISPENSER

(75) Inventor: Franck Plessis, Le Neubourg (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/101,180

(22) Filed: Mar. 20, 2002

(65) Prior Publication Data

US 2002/0179649 A1 Dec. 5, 2002

Related U.S. Application Data

(60) Provisional application No. 60/290,335, filed on May 14, 2001.

(30) Foreign Application Priority Data

Mar. 22, 2001 (FR) ..... 2001 03890

(51) Int. Cl.[7] ..... B65D 88/54
(52) U.S. Cl. ..... 222/321.9; 222/385
(58) Field of Search ..... 222/321.1, 321.7, 222/321.9, 383.1, 385

(56) References Cited

U.S. PATENT DOCUMENTS

| | | | | | |
|---|---|---|---|---|---|
| 3,937,366 | A | * | 2/1976 | Steiman | 222/321.9 |
| 5,845,819 | A | * | 12/1998 | de Pous | 222/321.9 |
| 6,010,039 | A | * | 1/2000 | Bougamont | 222/321.9 |
| 6,053,371 | A | * | 4/2000 | Durliat et al. | 222/321.9 |
| 6,250,510 | B1 | * | 6/2001 | Durliat et al. | 222/321.9 |
| 6,279,786 | B1 | * | 8/2001 | de Pous et al. | 222/321.9 |
| 6,371,337 | B2 | * | 4/2002 | Garcia et al. | 222/385 |

FOREIGN PATENT DOCUMENTS

| | | |
|---|---|---|
| FR | 2 792 295 A | 10/2000 |
| WO | 98 23391 A | 6/1998 |

* cited by examiner

*Primary Examiner*—Kevin Shaver
*Assistant Examiner*—Stephanie Willatt
(74) *Attorney, Agent, or Firm*—Sughrue Mion, PLLC

(57) ABSTRACT

A fluid dispenser comprising:

a receptacle (1) serving to contain the fluid, said dispenser forming an opening (10) defining an inside wall (11), said inside wall (11) forming a narrow opening section (13) below which the wall (11) is recessed at least locally outwards to form a recessed opening section (14);

a dispenser member (2), such as a pump or a valve, including a body (20); and a fixing ring (3) for fixing the body (20) of the dispenser member (2) in the opening (10) in the receptacle (1), said ring (3) comprising firstly body-receiving means (31) for receiving said body (20) and secondly a fixing skirt (32) serving to be engaged by force into said opening (10), said skirt (32) having an outside wall (320) defining a first zone (321) that comes into place at the narrow opening section (13), and a second zone (322) that comes into place at the recessed opening section (14), when the skirt (32) is engaged fully in the opening (10);

said dispenser being characterized in that, before the skirt is engaged in the opening, the first zone (321) has an outside diameter that is larger than the inside diameter of the narrow opening section (13).

13 Claims, 1 Drawing Sheet

FLUID DISPENSER

CROSS REFERENCE TO RELATED APPLICATION

This application claims the benefit under 35 U.S.C. §119 (e) of pending U.S. provisional patent application Serial No. 60/290,335, filed May 14, 2001, and priority under 35 U.S.C. §119(a)–(d) of French patent application No. FR-01.03890, filed Mar. 22, 2002.

TECHNICAL FIELD

The present invention relates to a fluid dispenser comprising a receptacle, a dispenser member such as a pump or a valve, and a fixing ring for fixing the dispenser member to the receptacle. Such dispensers are widely used in the fields of perfumes, of cosmetics, or indeed pharmaceuticals, for dispensing fluids by depressing a pusher manually using a finger.

BACKGROUND OF THE INVENTION

The present invention is concerned more particularly with a type of receptacle that forms an opening defining an inside wall which forms a narrow opening section below which the wall is recessed at least locally outwards to form a recessed bottom opening section. The fixing ring comprises firstly body-receiving means for receiving the body of the dispenser member and secondly a fixing skirt serving to be engaged by force into said opening. The skirt has an outside wall defining a first zone that comes into place at the narrow opening section, and a second zone that comes into place at the recessed opening section, when the skirt is engaged fully in the opening. A dispenser including such a fixing ring is known from Document U.S. Pat. No. 3,937,366. In that document, the inside wall of the neck of the receptacle is provided with a peripheral groove in which a rib formed on the outside wall of the skirt is snap-fastened. The portion of the skirt that is situated immediately above the rib has a diameter smaller than the diameter of the rib, even when the skirt is not yet engaged in the neck of the receptacle. It can be said that the outside profile of the skirt is exactly complementary to the inside profile of the neck of the receptacle. Similarly, the shape of the groove in the inside wall of the neck is exactly complementary to the shape of the rib on the skirt. Thus, there is no clamping radial contact between the skirt and the inside wall of the neck, but rather merely snap-fastening of the rib in the groove in the neck. Leakproofing between the skirt and the neck is thus very difficult to achieve.

BRIEF SUMMARY OF THE INVENTION

An object of the present invention is to remedy the drawbacks of the prior art by defining a fixing ring that achieves both secure fixing and excellent leakproofing.

To achieve this object, the present invention provides that, before the skirt is engaged in the opening, the first zone of the skirt has an outside diameter that is larger than the inside diameter of the narrow opening section. This is not so in Document U.S. Pat. No. 3,937,366, in which the first zone of the skirt has a diameter that is strictly equal to the diameter of the neck at the opening therein. Advantageously, the narrow opening section is substantially undeformable, and the first zone can be deformed over the narrow opening section. In this way, by choosing a skirt diameter that is larger than the diameter of the narrow opening section, the skirt is deformed by material creep, so that the narrow opening section bites into the outside wall of the skirt, thereby guaranteeing secure fixing and excellent leakproofing. The first zone radially deforming inwards generates powerful radial clamping against the narrow opening section of the opening.

According to another characteristic, the second zone has an outside diameter that is larger than the inside diameter of the narrow opening section and that is smaller than the maximum inside diameter of the recessed opening section. The second zone, which is forced radially inwards on passing through the narrow opening section, is then free to relax by radially expanding outwards at the recessed opening section. Since the second zone is not in contact with the inside wall of the neck at the recessed opening section, it is easier for material to creep from the first zone to the second zone due to the interference caused by the narrow opening section biting into the first zone.

According to another feature of the invention, the skirt is spaced apart from the body by an intermediate space. Thus, the skirt being deformed can in no way generate deformation of the body of the dispenser member.

Advantageously, the ring further comprises a peripheral flange which extends radially outwards from the top end of the skirt and which serves to come into abutment contact against the opening in the receptacle to limit the depth to which the skirt can be engaged in the opening.

Preferably, the flange serves as a thrust-transferring member for engaging the skirt into the opening.

According to another feature of the invention, the narrow opening section is connected downwards to the recessed opening section via a substantially frustoconical or flared transition section. Thus, after the skirt is engaged in the opening, the outside wall of the skirt co-operates with the narrow opening section and with the transition section to improve fixing and leakproofing.

In a variant, or in addition, the narrow opening section extends upwards via a substantially frustoconical or flared leading section. Thus, after the skirt is engaged in the opening, the outside wall of the skirt co-operates with the narrow opening section and with the leading section to improve fixing and leakproofing.

In a practical embodiment, prior to being engaged, the outside wall of the skirt is cylindrical and has a constant outside diameter at the first and second zones. Advantageously, the skirt has a bevelled free bottom end in order to facilitate inserting it into the opening in the receptacle.

BRIEF DESCRIPTION OF THE DRAWINGS

The invention is described more fully below with reference to the accompanying drawings which show an embodiment of the invention by way of non-limiting example. In the figures.

DETAILED DESCRIPTION

Figures 1, 2, 3:
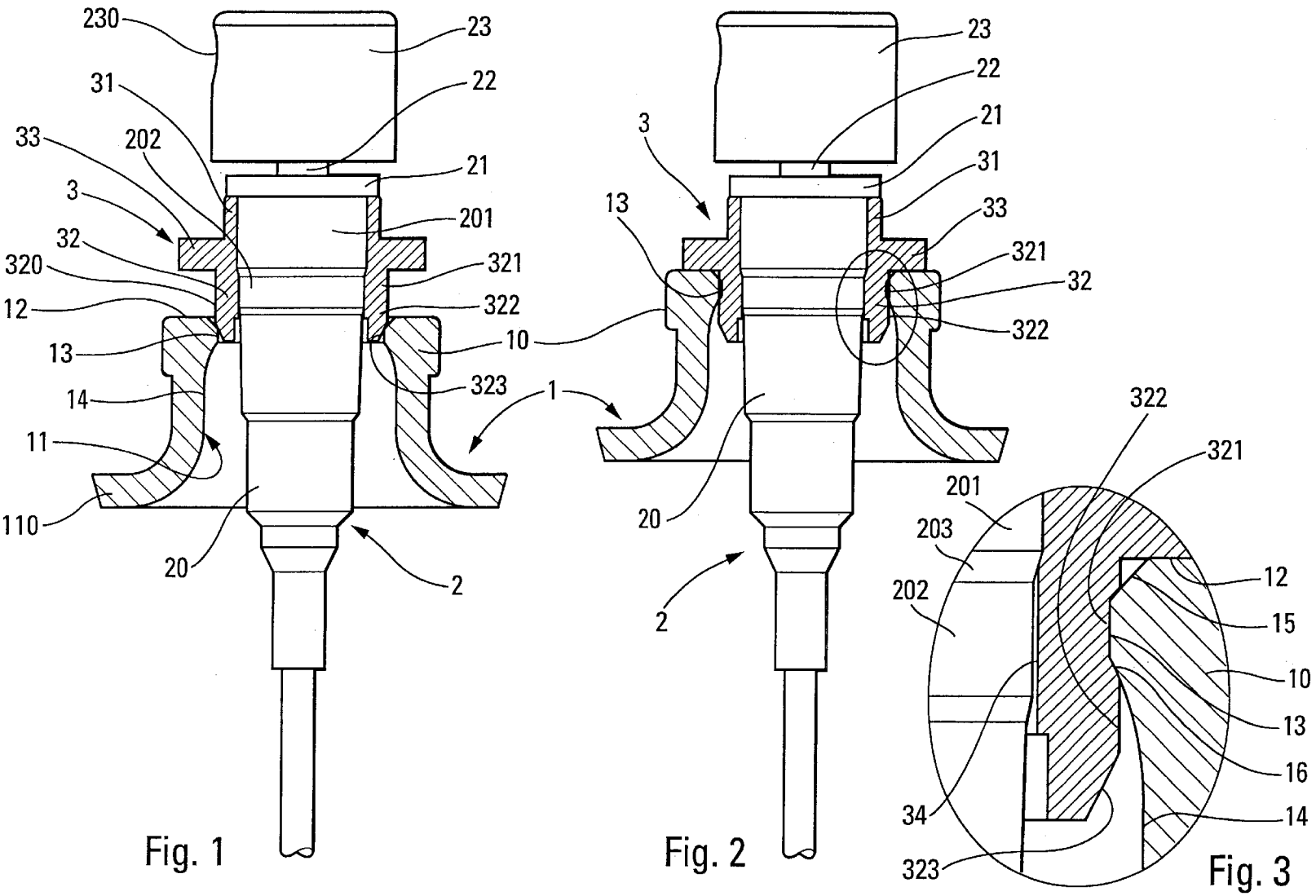
FIG. 1 is a section view through a fluid dispenser of the invention, immediately before the ring is engaged in the receptacle opening.
FIG. 2 is a view similar to the FIG. 1 view with the ring engaged in the opening in the receptacle.
FIG. 3 is an enlarged view of a detail of the ring, showing how the skirt co-operates with the opening.

FIGS. 1 and 2 show only the top portion of a fluid dispenser of the invention, so that the receptacle is represented by its neck 10 only. However, the dispenser of the invention comprises three component elements, namely a receptacle 1, a dispenser member 2 and a fixing ring 3.

In this example, the receptacle 1 is provided with a neck 10 which projects upwards from the body of the receptacle whose purpose is to store the fluid. The neck 10 defines an opening which makes it possible to communicate with the inside of the receptacle. However, it is possible to consider other embodiments for the receptacle, in which embodiments there is no projecting neck, but merely an opening in the body of the receptacle. With reference to FIGS. 1 and 2, it is possible, for example, to imagine that the end portion of the neck 10 is situated directly level with the shoulder 110. The receptacle then has an opening without a neck. The projecting neck is therefore not an essential element in the present invention. It suffices merely for there to be an opening that has certain characteristics. Among these characteristics, it can be seen in FIGS. 1 and 2 that the neck 10 has an inside wall 11 that is not cylindrical but rather that has a narrow opening section 13 below which a recessed opening section 14 is defined. The narrow opening section 13 is situated in the vicinity of the outlet of the neck which forms an annular top end 12 thereat. Advantageously, the narrow opening section 13 is connected to the top end 12 via a frustoconical or flared leading section 15. In addition, the narrow opening section 13 is connected to the recessed opening section 14 via a frustoconical or flared transition section 16. The narrow opening section 13 may be substantially cylindrical. The recessed opening section 14 may also be of substantially cylindrical section. It is possible for the recessed opening section 14 to be in the form of a peripheral recess which extends over a certain height of the neck, and which is extended downwards by another section of diameter substantially equal to the diameter of the narrow opening section 13. It is also possible for the recessed opening section to be in the form of a plurality of recesses distributed over the inside periphery of the neck. In other words, regardless of the form of the recessed opening section 14, it must at least locally have an inside diameter that is larger than the inside diameter of the narrow opening section 13. In the embodiment shown in the figures, the narrow opening section 13 is cylindrical, and the recessed opening section 14 extends downwards from the narrow opening section 13, starting with the flared transition section 16. It may be considered that the flared transition section 16 is part of the recessed opening section 14 because its diameter is larger than the inside diameter of the narrow opening section 13. The recessed opening section 14 then continues downwards to connect to the shoulder 110. Naturally, it is possible to omit the transition section 16 so that the recessed opening section 14 is connected to the narrow opening section 13 via a sharp-angled shoulder. In which case, it is not necessary to have a neck that extends over a certain height, and such an opening with a narrow section and a recessed section can be formed at the shoulder 110.

The dispenser member 2, which is a pump or a valve in this example, includes a pump body 20 defining an outwardly-projecting collar 21 at its top end. Below the collar, the pump body defines a body portion 201 below which a second body portion 202 of smaller diameter is connected so that, between the two body portions 201 and 202, there is a transition 203 in the form of a frustoconical step, as can be seen more clearly in FIG. 3. Below the second body portion 202, the body 20 defines another body portion having an even smaller diameter. It might be said that the body 20 is staggered in four stages because it comprises four body portions whose diameters decrease starting from the collar 21. This is merely a particular embodiment, and it is naturally possible for the body 20 to be exactly cylindrical. Conventionally, the pump 2 is provided with an actuator rod 22 that is slidably received in the body 20. The actuator rod 22 extends under a pusher 23 that defines a dispensing orifice 230. To actuate the pump 2, it suffices to depress the pusher 23 to push the rod 22 into the body 20, which causes a certain amount of fluid to be delivered through the rod 22 to the dispensing orifice 230. Such a pump or valve is quite conventional.

The purpose of the fixing ring 3 is to hold the dispenser member 2 and to fix it in the opening in the neck 10. For this purpose, the fixing ring 3 is provided with body-receiving means 31 in the form of a sleeve that is engaged snugly over the largest-diameter first body portion 201. The end of the sleeve 31 advantageously comes into abutment under the projecting collar 21. The ring 3 may be put in place over the body 20 by being engaged thereover by force. The fixing ring 3 is also provided with a fixing skirt 32 serving to be inserted into the neck 10. The skirt 32 extends substantially in alignment with the sleeve 31. It can be seen in FIG. 3 that the skirt 31 is not in contact with the body 20 at the second body portion 202, but rather an intermediate space 34 remains that prevents any contact or interference between the skirt 32 and the body 20. This is possible because the body 20 is staggered, but the same intermediate space 34 may be obtained by staggering the skirt relative to the sleeve 31. The skirt has an outside wall 320 that is substantially cylindrical before the skirt 32 is engaged into the neck 10, as can be seen in FIG. 1. At its bottom end, the skirt may be provided with a bevel 323 which makes it possible to facilitate inserting the skirt into the opening in the neck 10. However, above the bevel 323, the outside wall 320 of the skirt is substantially cylindrical.

In the invention, the outside diameter of the skirt 32 at its cylindrical outside wall 320 is larger than the inside diameter of the narrow opening section 13. Thus, to put the skirt 32 in place in the opening in the neck, as shown in FIGS. 2 and 3, it is necessary to engage it therein by force. To limit the depth to which the skirt is engaged in the opening in the neck, the ring 3 is provided with a peripheral flange 33 that extends radially outwards from the top end of the skirt 32. The final maximum engagement position is reached when the flange 33 comes into abutment against the top end 12 of the neck 10, as can be seen in FIGS. 2 and 3. The skirt 32 then extends both through the narrow opening section 13 and into the recessed opening section 14. More precisely, the skirt 32 also extends through the leading section 15 and through the transition section 16. Roughly speaking, two zones of the outside wall 320 of the skirt 32 can be defined, namely a first zone 321 which comes into place at the narrow opening section 13, and a second zone 322 which comes into place at the recessed opening section 14. Prior to engagement, these zones are indistinguishable, as can be seen in FIG. 1, since the outside wall 320 of the skirt 32 is cylindrical. It can be seen in FIG. 3 that the first zone 321 is deformed radially inwards by the narrow opening section 13, while the second zone 322 remains undeformed, since it is not in contact with the inside wall 11 of the neck at the recessed opening section 14. The first zone 321 of the skirt 32 is thus subjected to deformation by material creep. To make it possible for the material to creep in this way, it is necessary for the narrow opening section 13 to remain undeformed when the skirt 32 is engaged into the opening in the neck. In practice, this can be obtained by using materials of different hardness for the neck and for the fixing ring. For example, the receptacle 1 may be made of glass, and the fixing ring 3 may be made of plastic. However, it is also possible to make the receptacle 1 and the fixing ring 3 of the same material: the deformability characteristics of the skirt 32 can then be obtained through its design or through the thickness of its wall, for example. The height of section 13 may be reduced so that it may bite more easily into the first zone 321.

It can be noted that the outside wall 320 of the skirt 32 also comes into contact with the leading section 15 and with the transition section 16. This contributes to fixing the skirt in the opening, by means of a barb-fastening effect whereby the narrow opening section is used as an incident profile. This is not snap-fastening because, originally, i.e. prior to being engaged, the skirt has no recess serving to receive the narrow opening section 13. It should also be noted that leakproofing is significantly improved by using such a skirt, since the radial clamping at the first zone 321 is very strong, and in any event much stronger than fixing merely by snap-fastening as in Prior Art Document U.S. Pat. No. 3,937,366.

The outside wall 320 of the skirt 32 is shown as being exactly cylindrical. However, other shapes may be considered for the outside wall 320 of the skirt 32, e.g. staggered, with the outside diameter of the second zone 322 being larger than or smaller than the outside diameter of the first zone 321. The spirit of the invention lies in the fact that, prior to being engaged in the opening in the neck, the skirt 32 has a diameter larger than the diameter of the narrow opening section 13 so as to force the skirt to creep around the narrow opening section 13.

What is claimed is:

1. A fluid dispenser comprising:

a receptacle (1) serving to contain the fluid, said dispenser forming an opening (10) defining an inside wall (11), said inside wall (11) forming a narrow opening section (13) below which the wall (11) is recessed at least locally outwards to form a recessed opening section (14);

a dispenser member (2) including a body (20); and a fixing ring (3) for fixing the body (20) of the dispenser member (2) in the opening (10) in the receptacle (1), said ring (3) comprising firstly body-receiving means (31) for receiving said body (20) and secondly a fixing skirt (32) serving to be engaged by force into said opening (10), said skirt (32) having an outside wall (320) defining a first zone (321) that comes into place at the narrow opening section (13), and a second zone (322) that comes into place at the recessed opening section (14), when the skirt (32) is engaged fully in the opening (10);

said dispenser being characterized in that, before the skirt is engaged in the opening, the first zone (321) has an outside diameter that is larger than the inside diameter of the narrow opening section (13); and wherein the narrow opening section is substantially undeformable, and the first zone can be deformed along the narrow opening section.

2. A dispenser according to claim 1, in which the second zone (322) has an outside diameter that is larger than the inside diameter of the narrow opening section (13) and that is smaller than the maximum inside diameter of the recessed opening section.

3. A dispenser according to claim 1, in which the skirt (32) is spaced apart from the body (20) by an intermediate space (34).

4. A dispenser according to claim 1, in which the ring (3) further comprises a peripheral flange (33) which extends radially outwards from the top end of the skirt (32) and which serves to come into abutment contact against the opening (10) in the receptacle (1) to limit the depth to which the skirt can be engaged in the opening.

5. A dispenser according to claim 4, in which the flange (33) serves as a thrust-transferring member for engaging the skirt into the opening.

6. A dispenser according to claim 1, in which the narrow opening section (13) is connected downwards to the recessed opening section (14) via a substantially frustoconical or flared transition section (16).

7. A dispenser according to claim 6, in which, after the skirt is engaged in the opening, the outside wall (320) of the skirt (32) co-operates with the narrow opening section (13) and with the transition section (16).

8. A dispenser according to claim 1, in which the narrow opening section (13) extends upwards via a substantially frustoconical or flared leading section (15).

9. A dispenser according to claim 8, in which, after the skirt is engaged in the opening, the outside wall (320) of the skirt (32) co-operates with the narrow opening section (13) and with the leading section (15).

10. A dispenser according to claim 1, in which, prior to being engaged, the outside wall (320) of the skirt (32) is cylindrical and has a constant outside diameter at the first and second zones (321, 322).

11. A dispenser according to claim 1, in which the skirt (32) has a bevelled free bottom end (323) in order to facilitate inserting it into the opening (10) in the receptacle (1).

12. The dispenser according to claim 1, wherein the dispenser member is a pump.

13. The dispenser according to claim 1, wherein the dispenser member is a valve.

* * * * *